United States Patent [19]

Okada

[11] Patent Number: 4,509,724

[45] Date of Patent: Apr. 9, 1985

[54] PANTAGRAPH TYPE JACK

[75] Inventor: Hiroshi Okada, Seto, Japan

[73] Assignee: Mitsuchi Corporation, Nagoya, Japan

[21] Appl. No.: 493,553

[22] Filed: May 11, 1983

[30] Foreign Application Priority Data

May 15, 1982 [JP] Japan ..... 57-70988[U]

[51] Int. Cl.[3] ..... B66F 3/08

[52] U.S. Cl. ..... 254/126; 411/433

[58] Field of Search ..... 269/172–182; 254/126, 122, 98; 285/145, 323; 81/3 R; 403/16, 373; 411/432, 433, 267

[56] References Cited

U.S. PATENT DOCUMENTS

| | | | |
|---|---|---|---|
| 236,239 | 1/1881 | Morris | 269/181 |
| 1,683,912 | 9/1928 | Neblett | 269/174 |
| 1,774,926 | 9/1930 | Kruse | 254/126 |
| 2,705,983 | 4/1955 | Guadugna | 269/174 |
| 4,071,158 | 1/1978 | Maheu | 411/433 |
| 4,092,012 | 5/1978 | Ishigami | 254/126 |
| 4,363,164 | 12/1982 | Okada . | |

FOREIGN PATENT DOCUMENTS

| | | | |
|---|---|---|---|
| 67285 | 7/1948 | Denmark | 254/122 |

*Primary Examiner*—Robert C. Watson

*Attorney, Agent, or Firm*—Martin A. Farber

[57] ABSTRACT

Herein disclosed is a pantagraph type jack in which one of the support portions for supporting an actuating bolt forms a bolt-receiving nut. This bolt-receiving nut is equipped with a dump nut which is composed of a tapered bore and nut segments, and an actuating member which is composed of an actuating ring and a sleeve formed with openings, so that the turning operation of the actuating bolt can be omitted.

2 Claims, 3 Drawing Figures

PANTAGRAPH TYPE JACK

BACKGROUND OF THE INVENTION

1. Field of the Invention

The present invention relates to a pantagraph type jack and, more particularly, to a pantagraph type jack which is equipped with an improved dump nut.

2. Description of the Prior Art

The present applicant has already proposed a dump nut, as shown in FIG. 3, in which a nut is composed of a plurality of separate segments 5, these nut segments 5 are disposed in a tapered bore 2 of a casing 1 and are interposed between frictional guide projections 3 so that they can slide back and forth to expand and contract within the tapered bore 2, the tapered bore 2 of the casing is formed with receiving opening at its narrower end and with an insertion opening at its wider end so that it can allow a bolt to be inserted so as to extend therethrough, and the nut segments 5 are always biased to contact the smaller-diameter end of the tapered bore 2 by the action of a compression spring 9. The dump nut thus constructed is enabled to enjoy an outstanding advantage in that the operation of fastening it can be facilitated because it can be advanced without any rotation of the longitudinal path of a bolt 14 by expanding the nut segments 5 thereby separating their internal threads from the external thread of the bolt 14.

SUMMARY OF THE INVENTION

It is, therefore, an object of the present invention to facilitate the operations of a pantagraph type jack by improving and applying the above dump nut to the pantagraph type jack.

According to the present invention, an actuating member is equipped both with an actuating ring 16*a* which is slidably fitted over the outer surface of a casing 1, and a sleeve 16*b* into which a bolt 14 is inserted and which is formed both with openings 16*c* into which nut segments fit, and engagement portions 16*d* with which the rear end faces of the nut segments 5 engage.

The above and other objects, features and advantages of the present invention will become clear from the following description of the preferred embodiment taken in conjunction with the accompanying drawings.

BRIEF DESCRIPTION OF THE DRAWINGS

In the accompanying drawings showing one embodiment of the present invention.

DESCRIPTION OF THE PREFERRED EMBODIMENT

Figure 1:
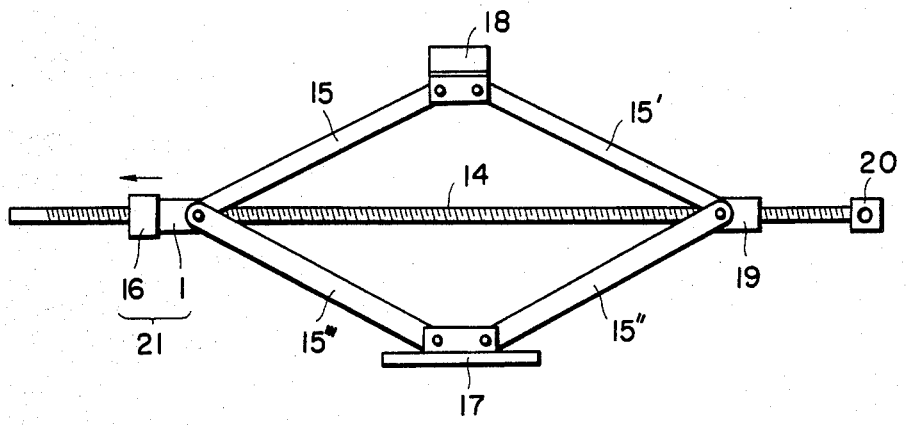
FIG. 1 is a side view showing a pantagraph type jack according to the present invention.
Figure 3:
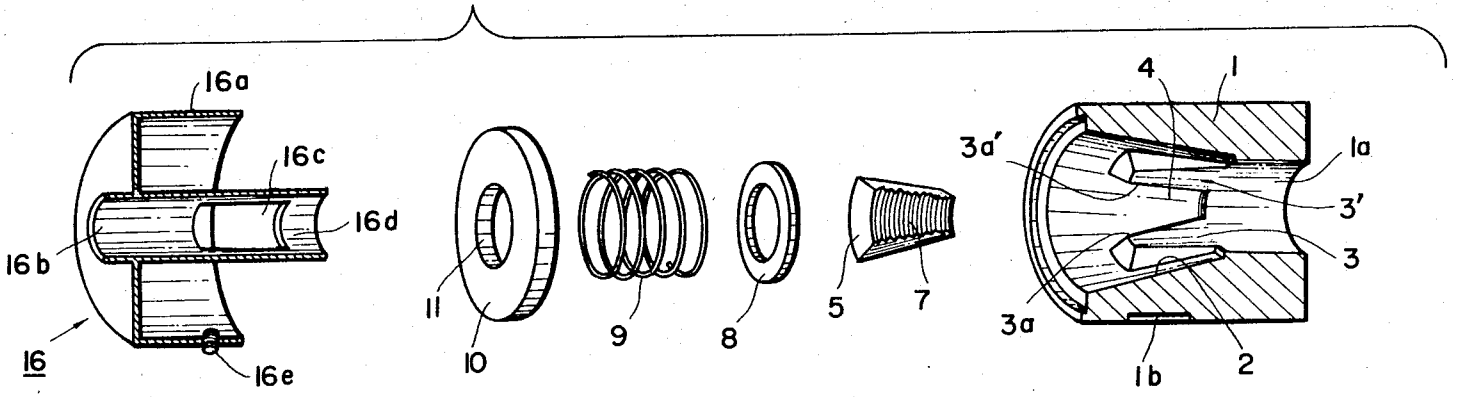
FIG. 3 is an exploded perspective view showing the essential parts thereof.

The present invention will be described in the following in connection with the embodiment thereof with reference to the accompanying drawings. First of all the description will be directed to a nut used in the present invention. With reference to FIGS. 1 and 3, reference numeral 1 indicates the casing of a nut 21, and numeral 2 indicates a tapered bore which has its front portion diverging and its front and rear ends open. Numerals 3, 3' and 3'' (the last is not shown) indicate three frictional guide projections which are formed on the inner wall of the tapered bore 2 integrally with the casing 1 and which each have their two side surfaces 3*a* and 3'*a* inclined so that the spaces 4 between the guide projections 3 and 3' are transversely narrowed toward the smaller-diameter end of the tapered bore and widened toward the front. The nut segments 5 are inserted in the spaces 4 so as to be longitudinally slidable. The nut body is constructed of the casing 1 and the nut segments 5. The rear end opening 1*a* of the casing 1 has a diameter larger than that of the bolt 14 used so that a later-described actuating member 16 can be fitted between the casing 1 and the bolt 14. Numeral 7 indicates threads formed on the nut segments 5, and numeral 8 a washer. Numeral 9 indicates a compression spring which is sandwiched between the washer 8 in contact with all three nut segments 5 and a cover 10 mounted on the casing 1 at the end of the larger opening of the tapered bore so as to thrust the three nut segments 5 toward the narrower end (i.e., backward) of the tapered bore at all times. An opening 11 for receiving the bolt is formed in the center of the cover 10. Numeral 16 indicates an actuating member which is equipped at its front end with an actuating ring 16*a* slidably fitted over the outer surface of the casing 1 and at its center with a sleeve 16*b* to receive the bolt 14, the sleeve 16*b* is formed with openings 16*c* into which the nut segments fit, and engagement portions 16*d* with which the rear end faces of the nut segments 5 engage.

Reference numeral 16*e* indicates a pin which is anchored to the actuating ring 16*a* and which has its inner end fitted into a groove 1*b* formed in the outer surface of the casing 1 to prevent the actuating ring 16*a* from coming off. Numerals 15, 15', 15'' and 15''' indicate support rods which are composed of parallel links and which are equipped with a base 17 at the bottom, a bed 18 at the top, the casing 1 forming the above nut at the front, and a bolt support 19 at the rear. The bolt 14 is mounted so as to extend through the nut 21 and the bolt support 19. Numeral 20 indicates a turning member for turning the bolt 14.

The operations of the pantagraph type jack will be described in the following.

Figure 2:
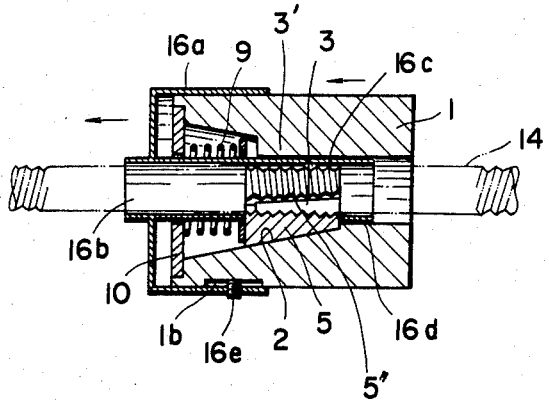
FIG. 2 is an enlarged sectional side view showing the essential parts thereof.

Turning to FIG. 2, which shows state in which the casing 1 forming the nut 21 has received the bolt 14, the nut segments 5, 5' and 5'' (the second segment is not shown) are pushed back by the action of the compression spring 9 so as to contract until their internal threads mesh with the external thread of the bolt 14. When, in this state, a load is applied to the bed 18, it acts as a force to thrust the casing 1 forward (i.e., in the direction of the arrow) so that a component thereof thrusts the nut segments 5, 5' and 5'' toward the bolt 14 because of the tapered bore 2. As a result, the nut segments 5, 5' and 5'' are forced into contact with the bolt 14 to bear the load.

Next, when the jack is being folded up after use, the actuating ring 16*a* is slid in the direction of the arrow. The nut segments 5, 5' and 5'' are then moved against the action of the compression spring 9 to the wider portion of the tapered bore 2 by the action of the engagement portions 16*d* so that they are expanded until they separate from the external thread of the bolt 14. As a result, if the casing 1 is moved in the direction of the arrow while the actuating ring 16*a* is held in the above movement position, the support bars 15, 15', 15'' and 15''' can be folded into a flat shape without any rotation of the bolt 14.

In order to erect the support bars 15, 15', 15'' and 15''' from that folded state, on the other hand, the casing 1 is pushed in the direction opposite to that of the arrow, or the bed 18 is lifted up to allow the casing to move in the direction opposite to that of the arrow by its own weight. The nut segments 5, 5' and 5'' are then held in their positions by their engagements with the bolt so that they are moved toward the larger-diameter end of the tapered bore 2 in the casing 1 until they are expanded. As a result, the threads of the nut segments 5, 5' and 5'' are allowed to ride over the thread of the bolt 14 so that the casing 1 can be moved in the direction opposite to that of the arrow without any rotation of the bolt 14 so that the bed 18 can be lifted rapidly and easily up to the base of an object to be elevated, e.g., the body of an automobile. By stopping the pushing operation of the casing 1 after the elevation to a predetermined position, moreover, the nut segments 5, 5' and 5'' are urged to mesh with the bolt 14 by the action of the compression spring 9 in the same way as in the above operations. After that, the jacking-up operation can be conducted by turning the bolt 14 in the usual manner.

As has been described hereinbefore, according to the present invention the transition between the folded position and the position immediately before use can be effected by sliding the casing 1 without any rotation of the bolt 14. The present invention can enjoy the advantage that the operations can be conducted very rapidly and easily, when compared with prior art jacks in which the change between the raised and folded positions is effected by turning the bolt 14 every time.

What is claimed is:

1. In a pantagraph jack of the type in which support bars forming parallel links are provided with a bolt support at one of their two connection portions and with a bolt-receiving nut at the other, and in which an actuating bolt is inserted into said two connection portions through said bolt support and said bolt-receiving nut, the improvement wherein:

a casing of said bolt-receiving nut is formed with a tapered through bore, said bolt-receiving nut comprising separate nut segments arranged slidably therein in the direction of the taper and being biased toward the smaller-diameter end of said tapered bore;

said bolt-receiving nut including an actuating member slidably mounted over said casing for thrusting said nut segments toward the larger-diameter end of said tapered bore; and wherein said actuating member for thrusting said nut segments toward the larger-diameter end of said tapered bore comprises an actuating ring which is slidably fitted over the outer surface of said casing, and a sleeve integrally formed with said actuating ring and having a center bore into which said actuating bolt is inserted; and wherein said sleeve is provided with openings into which said nut segments are fitted and engagement portions which engage with rear end faces of said nut segments.

2. A bolt-receiving nut comprising:

a casing, said casing being formed with a tapered through bore;

a set of separate nut segments located within said casing and being disposed circumferentially about a central axis of said casing, said nut segments being mounted within said casing slidably in the direction of taper of said bore;

means for biasing said nut segments toward the smaller diameter end of the taper of said bore;

an actuating member slidably mounted over said casing for thrusting said nut segments toward the larger diameter end of the taper of said bore, said actuating member comprising an actuating ring which is slidably fitted over the outer surface of said casing and an inner sleeve extending coaxially from said ring to pass along said bore adjacent said nut segments; and wherein said sleeve has sufficient diameter adapted to permit insertion therein of an actuating bolt which is engageable with said nut segments; said sleeve is formed with openings into which said nut segments are fitted, said openings defining engagement portions on said sleeve which engage with the rear end faces of said nut segments for releasing said nut segments from the actuating bolt upon a sliding of said actuating ring.

* * * * *